US005441433A

United States Patent [19]

Stanley

[11] Patent Number: 5,441,433

[45] Date of Patent: Aug. 15, 1995

[54] FLOATING STOOL

[76] Inventor: David L. Stanley, 1616 Glenwick, Plano, Tex. 75075

[21] Appl. No.: 230,646

[22] Filed: Apr. 21, 1994

[51] Int. Cl.[6] ..... B63C 9/08

[52] U.S. Cl. ..... 441/130; 472/128

[58] Field of Search ..... 297/4, 461; 441/136, 441/129, 130; 114/270, 188, 191, 194; 244/162; 472/128, 129; 482/77

[56] References Cited

U.S. PATENT DOCUMENTS 406,328 7/1889 Yagn ..... 297/4

3,203,694 8/1965 Kobashikawa ..... 472/129

4,451,080 5/1984 Nix ..... 297/4

4,971,317 11/1990 Link ..... 472/128

FOREIGN PATENT DOCUMENTS 0266099 10/1989 Japan ..... 244/162

*Primary Examiner*—Edwin L. Swinehart

*Attorney, Agent, or Firm*—John E. Vandigriff

[57] ABSTRACT

The invention is to a stool for use in a swimming pool. The stool has a single leg attached to a seat. A gripper device is placed on the end of the leg to prevent the leg from slipping when it engages the bottom of the pool.

17 Claims, 4 Drawing Sheets

FLOATING STOOL

FIELD OF THE INVENTION

This invention relates to a floating stool for use in swimming pools, and more particularly to a stool with a single leg support for use in swimming pools.

BACKGROUND OF THE INVENTION

There have been designed several floating seats for use in swimming pools, and for use as flotation devices on boats and aircraft. Most of these devices utilize a seat made from a material that will float in water, or are inflatable devices. For example, in U.S. Pat. No. 2,435,497, a floating seat is made from an inflatable annular tube. Several straps are used to support a seat or saddle within the annular tube. This seat floats on the top of the water.

A similar floating device is illustrated in U.S. Pat. No. 1,838,960. This device also utilizes an annular ring and a seat supported by straps attached to the annular float ring.

Prior art devices are flotation devices and float on or just below the surface of the water. The devices are not stationary and float around the water surface, and do not permit the user to remain at one spot.

Other known prior art which may be pertinent to the following invention are:

| | | |
|---|---|---|
| 3,671,988 | Newman | June 27, 1972 |
| 4,241,688 | Mansolill | December 30, 1980 |
| 4,798,550 | Biancucci | January 17, 1989 |
| 4,828,522 | Sentos | May 9, 1989 |

SUMMARY OF THE INVENTION

The invention is to a floating stool on which a person can sit at a stationary position in a body of water, such as a swimming pool. The floating stool has a seat portion attached to a single leg or support that has a length, that when a person sits on the stool in water, the leg end opposite the stool seat is pressed onto the bottom of the pool by the weight of the person. The leg has a gripping tip which does not slip against the bottom of the pool. Tip may be of a textured rubber, or may be in the form of a suction cup that attaches to the surface of the bottom of the pool. The leg may have a pair of foot rests, extending out from the leg, upon which a person, sitting upon the stool, may position their feet. The foot rests may include straps through which the foot is positioned to prevent the foot from slipping off the foot rest.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
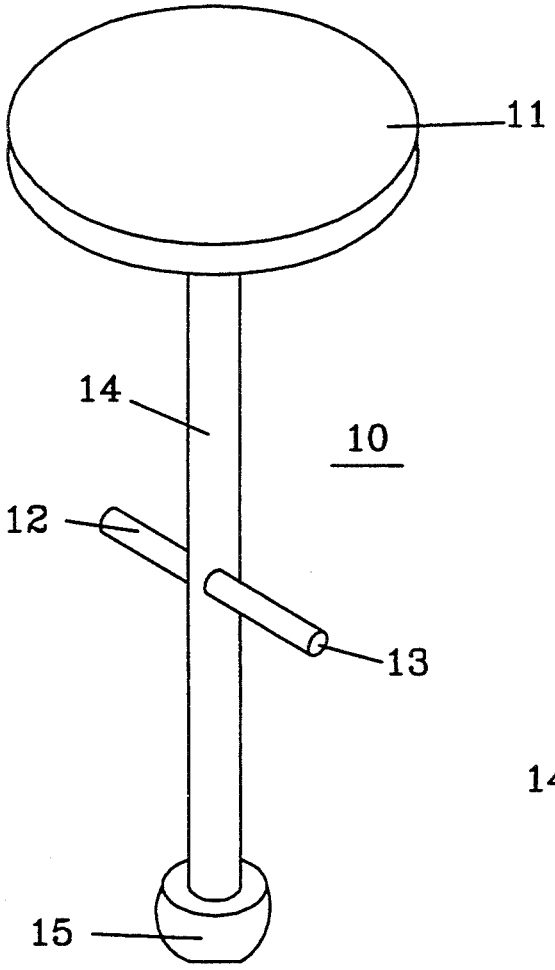
FIG. 1 shows an isometric drawing of the invention.
Figure 1A:
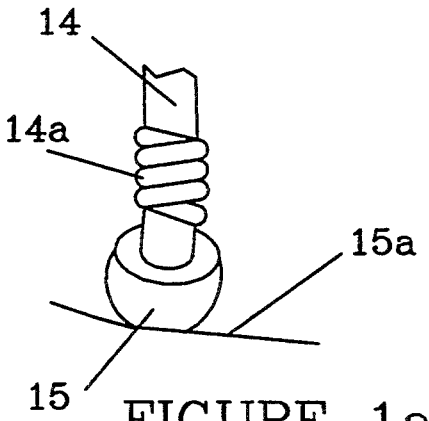
FIG. 1*a* shows a swivel spring on the stool leg.

FIG. 1 shows an embodiment of a floating stool for use in water, such as swimming pools. Stool 10 includes a seat portion 11 attached to one end of a single leg 14. On the end of leg 14 opposite the end on which seat 11 is attached is foot or gripping device 15 to prevent leg 14 from slipping when placed on a slightly sloping part of the bottom of a swimming pool. When a person sits on the stool in water, the weight of the person on seat 11 force the stool downward, engaging gripping device with the bottom of the pool. To prevent the single leg 14 from slipping when a person sits near the end of the pool where the bottom may slope downward, griping device prevents the end of leg from slipping along the sloped bottom of the pool. Gripping device may be, for example, a suction cup, or a rubber tip that has small depressions or ridges on the end that contacts the pool bottom, to provide a gripping surface. In order for the stool leg to be vertical, a swivel device such as a spring 14*a* may be at the end of the leg 14 adjacent to suction cup 15. This compensates for the sloped pool bottom 15*a*. A ball and socket swivel joint may also be used.

Stool 10 has a pair of horizontally extending foot rests 12 and 13. Foot rests 12 and 13 are shown circular in cross section, but may be flat on the top area where a foot is positioned.

Figure 2:
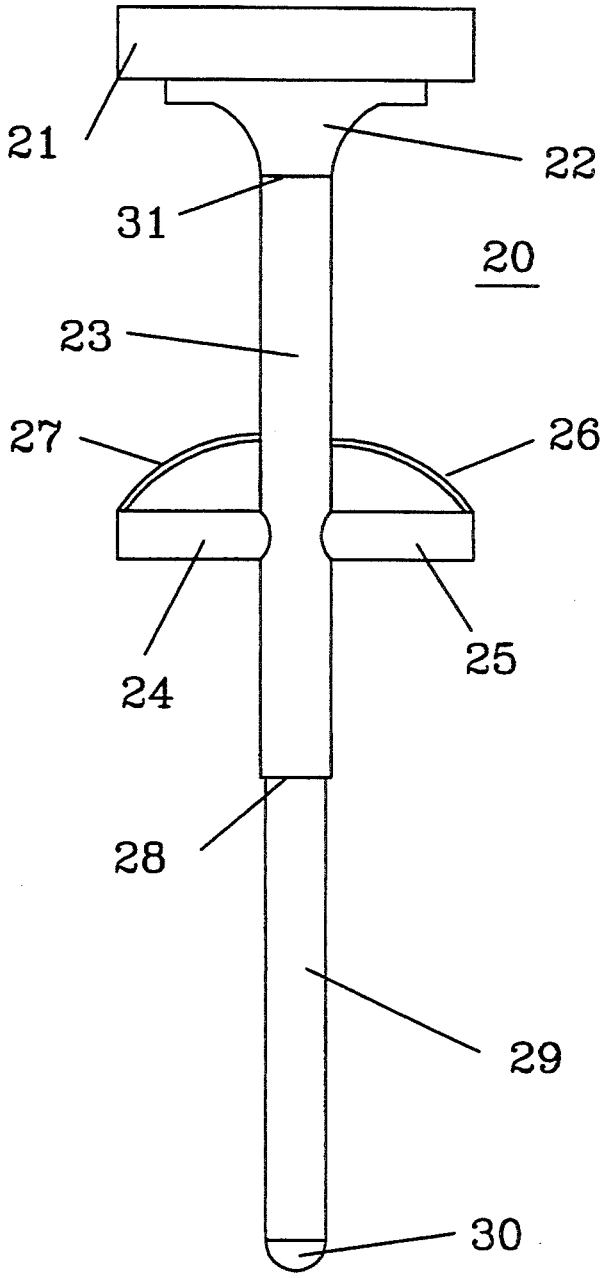
FIG. 2 is a side view of the invention.

FIG. 2 is a side view of a stool having a seat 21 secured to leg 23 by a mount 22. Mount 22 provides the means for securing seat 21 to leg 23. Seat 21 may be rigidly fastened to mount 22, and mount 22 may be either rigidly secured to leg 23, or may be rotatably secured to leg 23 to permit a person sitting on stool 20 to pivot around with out moving leg 23.

The stool leg has in two parts, upper part 23 and lower part 29. Lower part 29 telescopes into upper part 23 at 28 to provide an adjustment for using the stool in areas of a swimming pool of different depths. Upper leg part 23 and lower leg part 29 are held in place by an internal twist lock or by a thumb screw, neither of which are illustrated in FIG. 2.

Secured to upper leg part 23 are two foot rests 24 and 25. Foot rest 24 includes a strap 27 and foot rest 25 has a strap 26. Straps 26 and 27 help a seated person maintain a wet foot on a foot rest. Also, the straps may be used to help a person move the seat around the pool. By pushing and/or pulling upward, the person can take weight off the stool, pulling the stool single leg off the bottom of the pool by the straps and move the stool to another position.

Bottom leg part has a gripping device 30 positioned on the end of leg 29 opposite the end telescoped into upper leg part 23.

Figure 3:
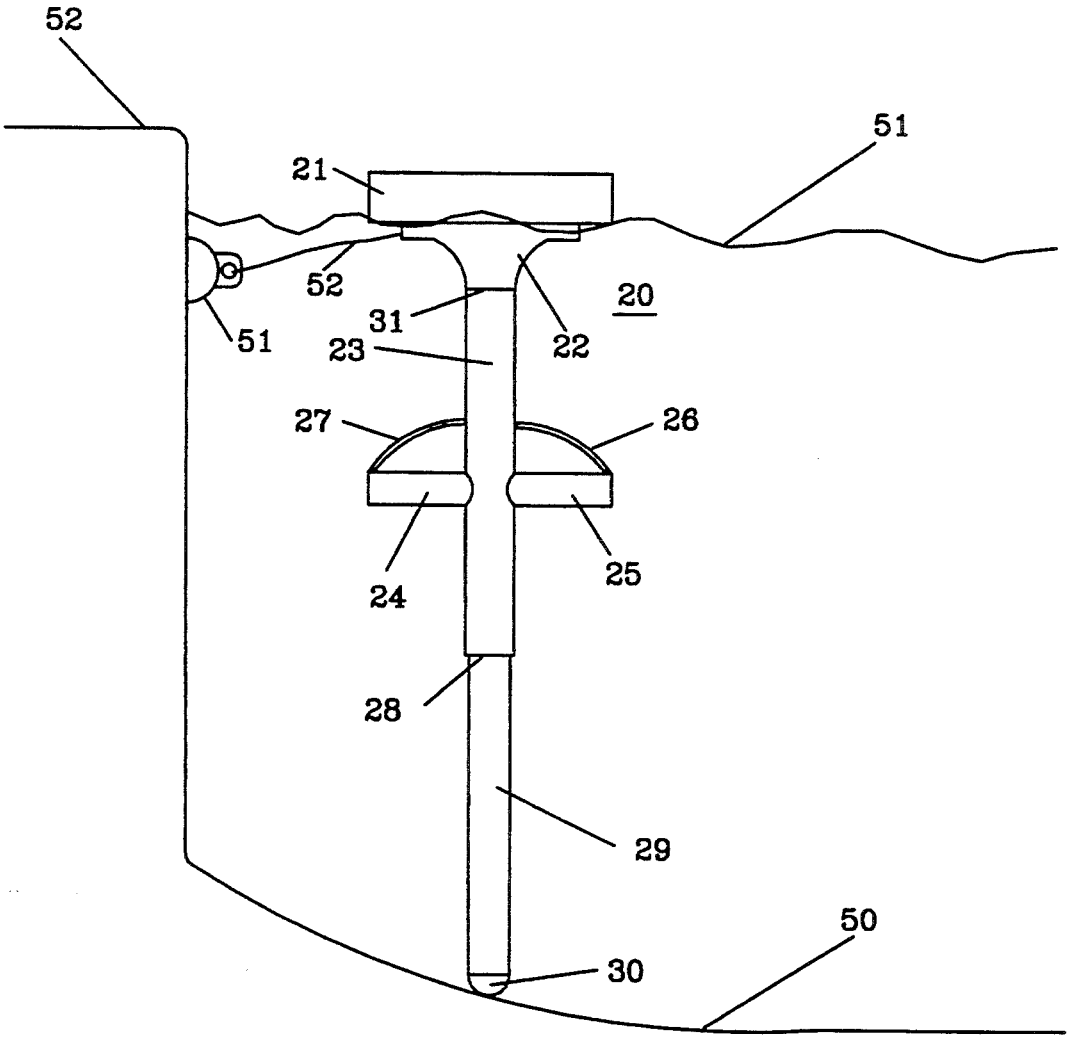
FIG. 3 shows the invention in a swimming pool.

FIG. 3 shows the stool of FIG. 2 in a swimming pool. Stool 20 has the end of lower leg 29 positioned against pool bottom 50 by gripper device 30. Stool 20 has leg parts 23 and 29 adjusted to place the top of stool 20 at water level 51 in pool 52. Although pool bottom 50 is sloped where gripper device 30 contacts the bottom 50, the weight of a person sitting on stool 20, in combination with the gripping bottom surface of gripper device 30 prevents the single leg from slipping.

Attached to the stool is a cord 52 connected to a suction cup 51. Cord 52 and cup 51 attaches the stool to the side of the pool so that the stool will not float out of reach when not in use.

Figure 4:
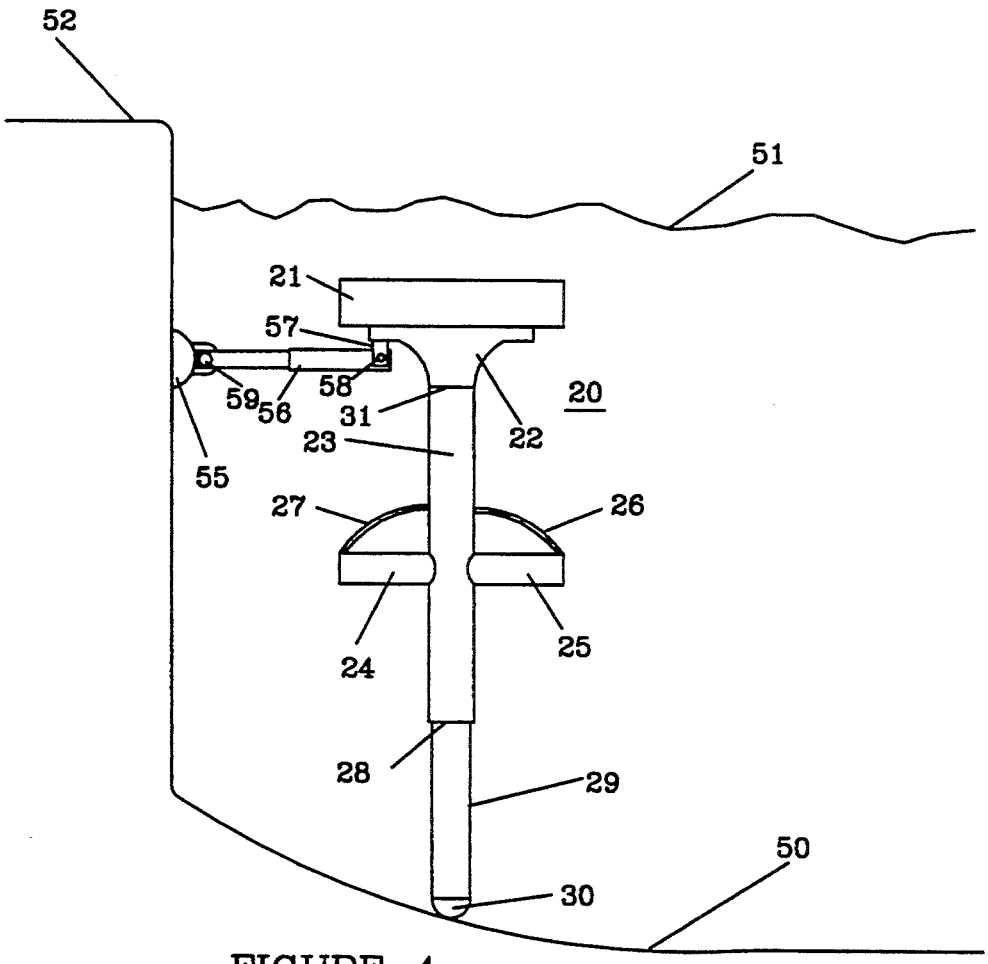
FIG. 4 the stool of the invention positioned under water.

FIG. 4 shows stool top positioned below the water level 51. A person sitting on the stool may adjust the leg parts 23 and 29 to position the body at water level of below water level as desired.

Attached to stool 20 is an anchor bar 59 attached to seat support 22 at pivot point 58. The other end of anchor bar 59 has a suction cup 55 attached by pivot point 59. Bar 56 is telescoping to adjust to various lengths. Anchor bar 59 helps stabilize stool 20 and anchor it adjacent to the pool edge 52.

The stool described herein may be of a plastic or light metal, such as aluminum, and floats upright on the surface of the water when a person is not sitting on the stool. The adjustable feature of the stool leg permits its use in different parts of the pool which have different depths.

What is claimed:

1. A floating stool for use in a swimming pool, comprising:

a seat, a single leg attached to and extending from said seat, and a suction gripping device on said single leg for gripping the bottom of the swimming pool when a person is sitting on the stool.

2. The stool according to claim 1, including foot rests attached to and extending from said single leg.

3. The stool according to claim 2, including straps attached to said foot rests for securing a foot in each rest.

4. The stool according to claim 1, wherein said seat is rotatably attached to said single leg.

5. The stool according to claim 1, wherein said stool is made from materials to permit said stool to float in water when a person is not sitting on said stool.

6. The stool according to claim 1, wherein said single leg has two parts, one which telescopes into the other.

7. A floating stool for use in a swimming pool, comprising:

a rotatable seat, a single, adjustable leg attached to and extending from said seat, and a suction gripping device on said single leg for gripping the bottom of the swimming pool when a person is sitting on the stool.

8. The stool according to claim 7, including foot rests attached to and extending from said single leg.

9. The stool according to claim 8, including straps attached to said foot rests for securing a foot in each rest.

10. The stool according to claim 7, wherein said seat is rotatably attached to said single leg.

11. The stool according to claim 7, wherein said single adjustable leg has two parts, one which telescopes into the other.

12. The stool according to claim 11, where said two parts of said single adjustable leg includes a locking device to hold the two parts in a fixed relation, one to the other.

13. A floating stool for use in a swimming pool, comprising:

a seat, a single, adjustable leg, having upper and lower parts, attached to and extending from and rotatably attached to said seat, and a suction gripping device on said single leg for gripping the bottom of the swimming pool when a person is sitting on the stool.

14. The stool according to claim 13, including foot rests attached to and extending from the upper part of said leg.

15. The stool according to claim 14, including straps attached to said foot rests for securing a foot in each rest.

16. The stool according to claim 13, including a spring-pivot device between the single leg and the gripping device.

17. The stool according to claim 13, including an attachment device to attach the stool to the side of a swimming pool.

* * * * *